US011988475B2

(12) United States Patent
Kunsky

(10) Patent No.: US 11,988,475 B2
(45) Date of Patent: May 21, 2024

(54) FIREARM SUPPRESSOR QUICK CONNECT

(71) Applicant: Jacob Kunsky, Bruneau, ID (US)

(72) Inventor: Jacob Kunsky, Bruneau, ID (US)

( * ) Notice: Subject to any disclaimer, the term of this patent is extended or adjusted under 35 U.S.C. 154(b) by 79 days.

(21) Appl. No.: 17/486,104

(22) Filed: Sep. 27, 2021

(65) Prior Publication Data

US 2023/0099174 A1 Mar. 30, 2023

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 42/107; 89/14.2–14.4; 181/223
See application file for complete search history.

(56) References Cited

U.S. PATENT DOCUMENTS 2,514,996 A * 7/1950 Faust, Jr. ..... F41A 21/34 181/223
3,667,570 A * 6/1972 WerBell, III ..... F41A 21/30 89/14.4
4,510,843 A * 4/1985 Rabatin ..... F41A 21/325 89/14.4
6,374,718 B1 * 4/2002 Rescigno ..... F41A 21/30 89/14.4
7,661,349 B1 * 2/2010 Brittingham ..... F41A 21/30 42/1.06
8,516,941 B1 * 8/2013 Oliver ..... F41A 21/30 89/14.4
8,671,818 B1 * 3/2014 Oliver ..... F41A 21/34 89/14.4
9,182,187 B1 * 11/2015 Griffith ..... F41A 21/325
9,829,264 B1 * 11/2017 Berglund ..... F41A 21/30
9,891,017 B1 * 2/2018 Lee ..... F41A 21/325
10,082,354 B1 * 9/2018 Lee ..... F41A 21/325
10,415,917 B2 * 9/2019 White ..... F41A 21/38
10,690,433 B2 * 6/2020 Oliver ..... F41A 21/30
10,883,788 B2 * 1/2021 Marcotte ..... F41A 21/482
11,112,200 B2 * 9/2021 Lawson ..... F41A 21/30
2019/0195589 A1 * 6/2019 Lee ..... F41A 21/30
2020/0173751 A1 * 6/2020 Dorne ..... F41A 21/30
2021/0018287 A1 * 1/2021 Kada ..... F41A 21/30
2021/0116200 A1 * 4/2021 Graham, II ..... F41A 21/30
2022/0163281 A1 * 5/2022 Madigan ..... F41A 21/30
2022/0221242 A1 * 7/2022 Berglund ..... F41A 21/30

* cited by examiner

*Primary Examiner* — Joshua E Freeman
*Assistant Examiner* — Benjamin S Gomberg
(74) *Attorney, Agent, or Firm* — Parsons Behle & Latimer

(57) ABSTRACT

Apparatuses, systems, and methods regarding an end cap for a firearm suppressor that enables the quick connect of another suppressor. The firearm suppressor includes a base that includes a first projectile pathway and is configured to be connected to a barrel of a firearm. The suppressor includes a baffle having a central aperture and an end cap having a first central opening and a second central opening. The baffle is positioned between the end cap and the base. The end cap includes a connector. The end cap includes a second projectile pathway that connects the first central opening and the second central opening. The connector is configured to connect to a second firearm suppressor. The connector may be a quick connect connector. The connector may include external threads, internal threads, one or more external lugs, and/or external locking teeth.

20 Claims, 4 Drawing Sheets

FIREARM SUPPRESSOR QUICK CONNECT

FIELD OF THE DISCLOSURE

The examples described herein relate to apparatuses, systems, and methods of an end cap for a firearm suppressor that includes a connector to enable the rapid connection of a second firearm suppressor to a firearm via the end cap.

BACKGROUND

Description of the Related Art

A firearm suppressor is a device mounted or otherwise attached to the muzzle of a firearm and, through selective use of baffles or other gas-redirection apparatus, operates to diminish the report (as measured in decibels) of a portable firearm following discharge. By reducing the report of a discharging firearm, suppressors reduce or mitigate hearing damage or loss otherwise resulting from repeated exposure to firearm discharges. A suppressor may be attached to a firearm by various mechanisms.

Attaching a suppressor to a firearm generally causes a buildup in gas pressure within the suppressor upon discharge of the firearm. The pressure buildup can cause the cycling of the bolt of the firearm to increase. The increased speed of the bolt may jam the firearm, cause increased wear and tear on the bolt carrier group, and/or may increase the recoil. Tactical personnel may not want to leave a suppressor connected to the end of a firearm at all times due to the increased length and/or weight of the firearm. However, certain situations may necessitate the addition of a suppressor to a firearm out in the field. It may be important for the suppressor to be rapidly connected to the firearm. The addition of the suppressor to the firearm changes the operation of the gas system of the firearm. A user may not have time to properly adjust the gas system, which may lead to suboptimal performance of the firearm. Other disadvantages may exist.

SUMMARY

The present disclosure is directed to apparatus, systems, and methods of an end cap for a firearm suppressor that includes a connector that enables the quick connect of a second firearm suppressor to the end of a firearm via the end cap.

One example of the present disclosure is a firearm suppressor. The firearm suppressor includes a base configured to be connected to a barrel of a firearm. The base includes a first projectile pathway through the base. The firearm suppressor includes a baffle having a central aperture and an end cap having a first central opening and a second central opening. The baffle is positioned between the end cap and the base. The end cap includes a connector that extends from the end cap away from the baffle. The end cap includes a second projectile pathway that connects the first central opening and the second central opening. The connector is configured to connect to a second firearm suppressor.

The baffle of the firearm suppressor may be connected to the base and the baffle may be connected to the end cap. The firearm suppressor may include a housing. A portion of the base may be positioned within the housing, the baffle may be positioned within the housing, and a portion of the end cap may be positioned within the housing. The base of the firearm suppressor may be connected to the housing and the end cap may be connected to the housing. The baffle may be connected to the housing and the baffle may be connected to the end cap.

The firearm suppressor may include an adapter having a third projectile path and the adapter may be positioned between the base and the baffle. The connector of the firearm suppressor may include external threads. The connector of the firearm suppressor may include one or more external lugs. The connector of the firearm suppressor may include external threads and external locking teeth. The connector of the firearm suppressor may include internal threads.

One embodiment of the present disclosure is an end cap. The end cap includes a radial circular flange having a first side and a second side opposite of the first side. The end cap includes an axial circular flange that extends from the first side of the radial circular flange, the axial circular flange includes exterior threads. The end cap includes a first opening located adjacent to the first side of the radial circular flange. The end cap includes a connector that extends from the second side of the radial circular flange, wherein the connector is configured to connect to a firearm suppressor. The end cap includes a second opening located on an end of the connector and a projectile path that connects the first opening to the second opening. The connector may include external threads. The connector may include one or more external lugs. The connector may include external threads and external locking teeth. The connector may include internal threads.

One embodiment of the disclosure is a firearm suppressor system. The firearm suppressor system includes a base configured to be connected to a barrel of a firearm, the base includes a first projectile pathway through the base. The firearm suppressor system includes a first baffle having a central aperture. The firearm suppressor system includes an end cap having a first central opening and a second central opening. The baffle is positioned between the end cap and the base. The end cap includes a connector that extends from the end cap away from the baffle. The end cap includes a second projectile pathway that connects the first central opening and the second central opening. The firearm suppressor system includes a firearm suppressor that includes one or more baffles connected to the connector.

The firearm suppressor system may include an adapter having a third projectile path and the adapter may be positioned between the base and the first baffle. The firearm suppressor system may include a housing. A portion of the base may be positioned within the housing. The first baffle may be positioned within the housing. A portion of the end cap may be positioned within the housing. The connector of the firearm suppressor system may include external threads. The connector of the firearm suppressor system may include one or more external lugs. The connector of the firearm suppressor system may include external threads and external locking teeth. The connector of the firearm suppressor system may include internal threads.

Figure 1:
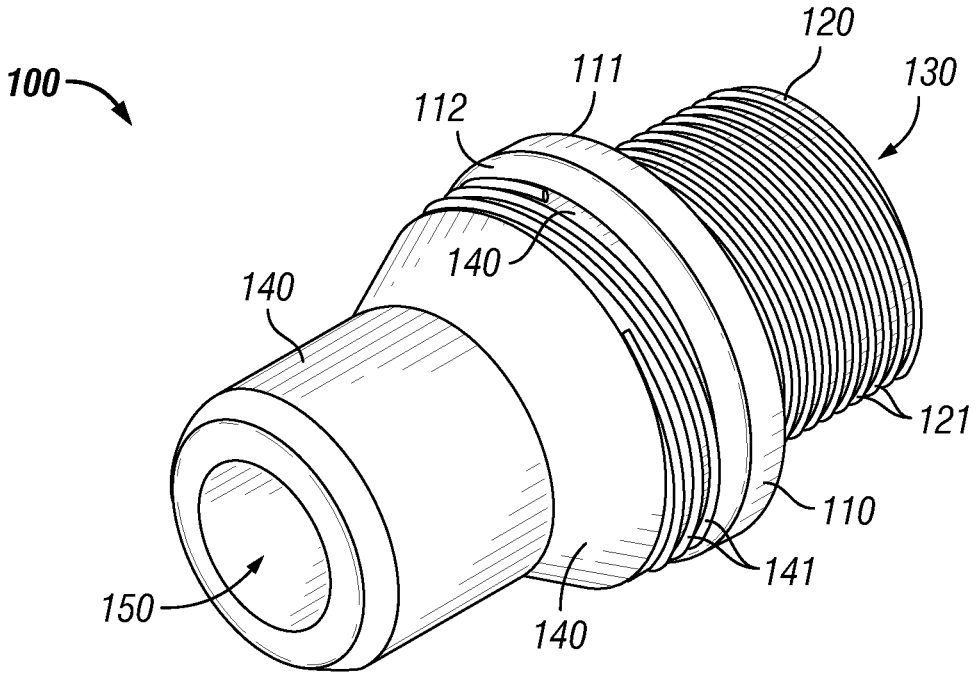
FIG. 1 is a perspective view of an embodiment of an end cap that includes a quick connect connector.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

As used herein, a quick connect connector is a connector that enables a suppressor to be connected within five (5) seconds or less and without the use of tools. FIG. 1 shows an embodiment of an end cap 100. The end cap 100 includes a radial circular flange 110 having a first side 111 and a second side opposite 112 of the first side 111. The end cap 100 includes an axial circular flange 120 that extends from the first side 111 of the radial circular flange 110. The axial circular flange 120 includes threads 121. The threads 121 may be on the exterior of the axial circular flange 120 as shown in FIG. 1. Alternatively, the threads 121 may be on the interior of the axial circular flange 120 as would be appreciated by one of ordinary skill in the art having the benefit of this disclosure. The end cap 100 includes a first opening 130 (shown in FIG. 3) that is located adjacent to the first side 111 of the radial circular flange 110. The end cap 100 includes a connector 140 that extends from the second side 112 of the radial circular flange 110. The connector 140 is configured to connect to a firearm suppressor. The connector 140 may be a quick connector that enables a firearm suppressor to be connected to the end cap within five (5) seconds or less and without the use of tools. The end cap 100 includes a second opening 150 located at the end of the connector 140. The end cap 100 includes a projectile path 160 (shown in FIG. 3) that connects the first opening 130 with the second opening 150.

The connector 140 of the end cap 100 enables a suppressor to be quickly connected to a short or compact suppressor already connected to a firearm as discussed herein. The connector 140 may include various quick connect connections as would be appreciated by one of ordinary skill in the art having the benefit of this disclosure. For example, the connector 140 may include, but is not limited to, external threads 141, one or more external lugs 142 (shown in FIG. 5), course external threads 143 with a ring of locking teeth 144 (shown in FIG. 8), or the like.

Figure 2:
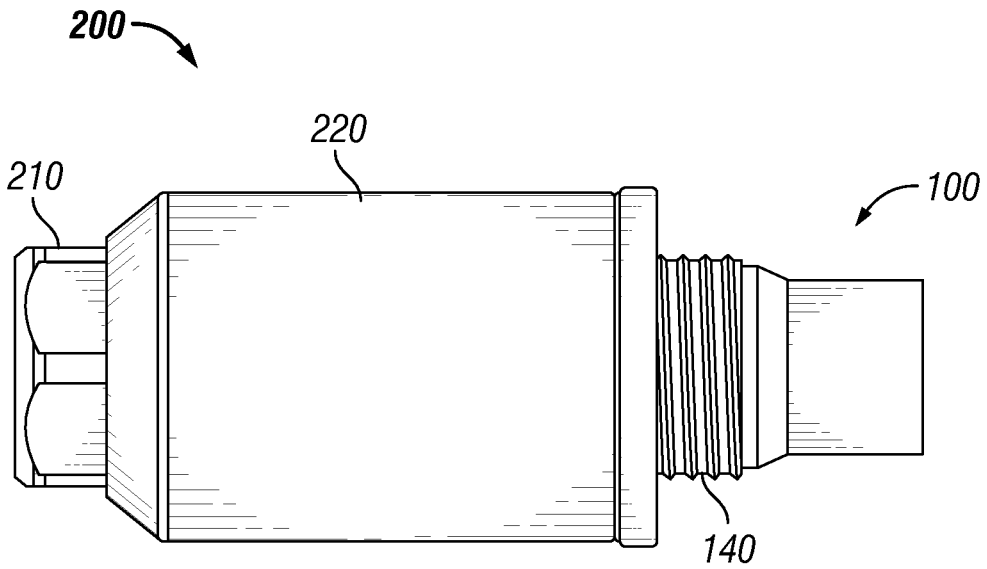
FIG. 2 is a side view of an embodiment of a suppressor that includes an end cap having a quick connect connector.

FIG. 2 shows an embodiment of a short or compact suppressor 200 that includes an end cap 100 having a connector 140. The suppressor 200 includes a base 210 that is configured to connect the suppressor 200 to a firearm. The suppressor 200 includes a housing 220 that is positioned between the base 210 and the end cap 100. The suppressor 200 includes at least one baffle 230 (shown in FIG. 3) within the housing 220. The short or compact suppressor 200 is preferably short in length with respect to traditional firearm suppressors. Thus, the suppressor 200 may only include a single baffle positioned between the base 210 and the end cap 100.

The short or compact suppressor 200 may be attached to the end of a firearm to suppress the discharge of the firearm to some extent. However, the short or compact suppressor 200 does not add much length or weight to the end of the firearm due to the compact nature of the suppressor 200. The compact suppressor 200 may be used to adjust the gas system of a firearm as the chamber between the baffle and the base 210 will cause a pressure increase upon discharge of the firearm. As discussed above, the pressure increase could potentially lead to an increase in the bolt speed of a firearm. The gas system may be adjusted with the compact suppressor 200 connected to the firearm to decrease the speed of the bolt to be at or close to the normal speed when discharged without a suppressor. A second suppressor may be rapidly connected to the compact suppressor 200 via the connector 140 as discussed herein. The second suppressor may be requisite due to an increased need to further suppress the discharge of a firearm. The connector 140 may be configured to enable a second suppressor to be connected to the firearm via the connector within five (5) seconds or less and without the use of tools. While the addition of a second suppressor may increase the pressure buildup, the increase in the pressure buildup is likely much lower in magnitude than the increase in pressure caused by the prior addition of the compact suppressor 200. Thus, a user may be able to use a firearm with a second suppressor connected to the compact suppressor 200, which was already connected to the gun, without a detrimental increase the in the bolt speed of the firearm.

Figure 3:
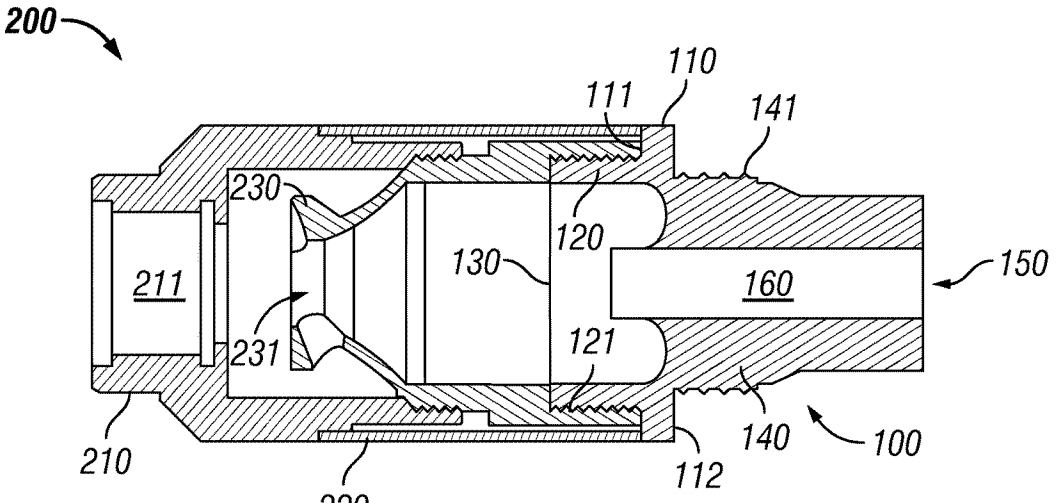
FIG. 3 is a cross-section view of an embodiment of a suppressor that includes an end cap having a quick connect connector.

FIG. 3 shows a cross-section view of a compact suppressor 200. The short or compact suppressor 200 includes an end cap 100 having a connector 140. The suppressor 200 includes a base 210 that is configured to connect the suppressor 200 to a firearm. The base 210 includes a first projectile path 211 that travels along the centerline of the base 210. The suppressor 200 includes a housing 220 that is positioned between the base 210 and the end cap 100.

The suppressor 200 includes at least one baffle 230 within the housing 220. The baffle 230 includes a central aperture 231. The short or compact suppressor 200 is preferably short in length with respect to traditional firearm suppressors. Thus, the suppressor 200 may only include a single baffle 230 positioned between the base 210 and the end cap 100. Alternatively, the suppressor 200 may include two baffles 230 between the base 210 and the end cap 100.

The end cap 100 includes a radial circular flange 110 having a first side 111 and a second side opposite 112 of the first side 111. The end cap 100 includes an axial circular flange 120 that extends from the first side 111 of the radial circular flange 110. The axial circular flange includes exterior threads 121. The end cap 100 includes a first opening 130 that is located adjacent to the first side 111 of the radial circular flange 110. The end cap 100 includes a connector 140 that extends from the second side 112 of the radial circular flange 110. The connector 140 extends away from the baffle 230 of the compact firearm suppressor 200.

The connector 140 is configured to connect to a firearm suppressor. The connector 140 may be a quick connector that enables a firearm suppressor to be connected to the end cap within five (5) seconds or less and without the use of tools. The end cap 100 includes a second opening 150 located at the end of the connector 140. The end cap 100 includes a second projectile path 160 that connects the first opening 130 with the second opening 150. The first projectile path 211 of the base 210 is aligned with the central aperture 231 of the baffle 230 as well as the second projectile path 160 of the end cap 100.

Figure 4:
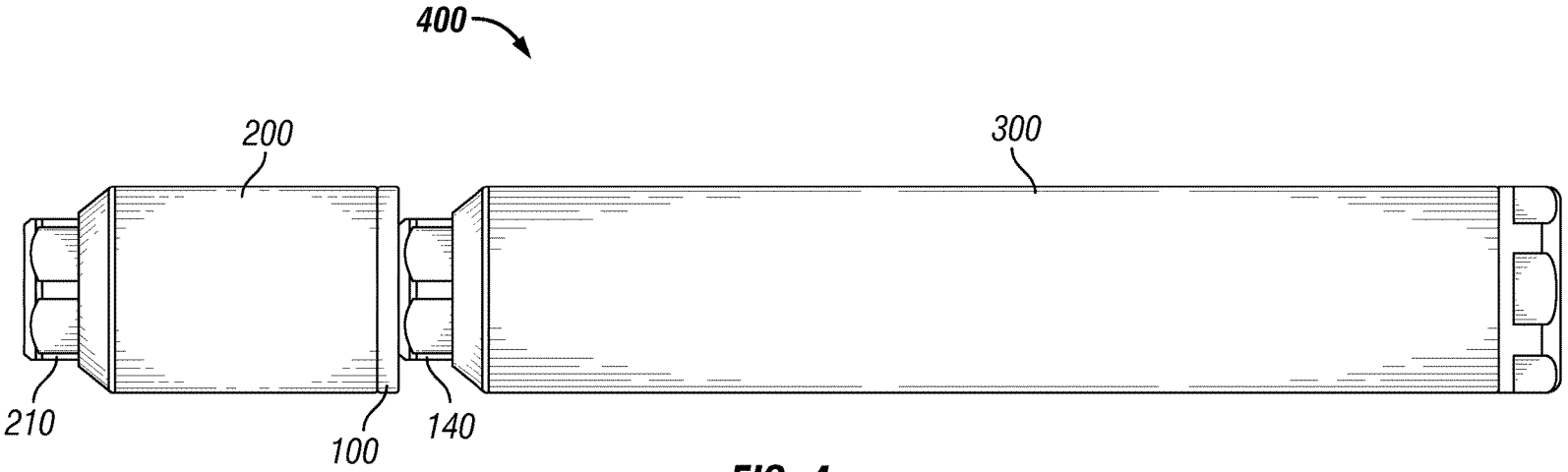
FIG. 4 shows a schematic of a firearm suppressor system with a suppressor that includes an end cap having a quick connect connector with a second suppressor connected via the quick connect connector on the end cap.

FIG. 4 shows an embodiment of a firearm suppressor system 400. The firearm suppressor system 400 includes a second firearm suppressor 300 connected to the compact suppressor 200 via the connector 140 of the end cap 100 of the compact suppressor 200. The firearm suppressor system 400 includes a base 210 (shown in FIGS. 2 and 3) configured to be connected to a barrel of a firearm. The base 210 includes a first projectile pathway 211 (shown in FIG. 3) through the base 210. The firearm suppressor system 400 includes a first baffle 230 (shown in FIG. 3) having a central aperture 231 (shown in FIG. 3). The firearm suppressor system 400 includes an end cap 100 having a first central opening 130 (shown in FIG. 3) and a second central opening 150 (shown in FIG. 3), the baffle 230 being positioned between the end cap 100 and the base 210. The end cap 100 includes a connector 140 that extends from the end cap 100 away from the baffle 230. The end cap 100 includes a second projectile pathway 160 (shown in FIG. 3) that connects the first central opening 130 and the second central opening 150. The firearm suppressor system 400 includes a second firearm suppressor 300 connected to the connector 140 of the end cap 100. The second firearm suppressor 300 includes one or more baffles to suppress the discharge of the firearm as would be appreciated by one of ordinary skill in the art having the benefit of this disclosure.

Figure 5:
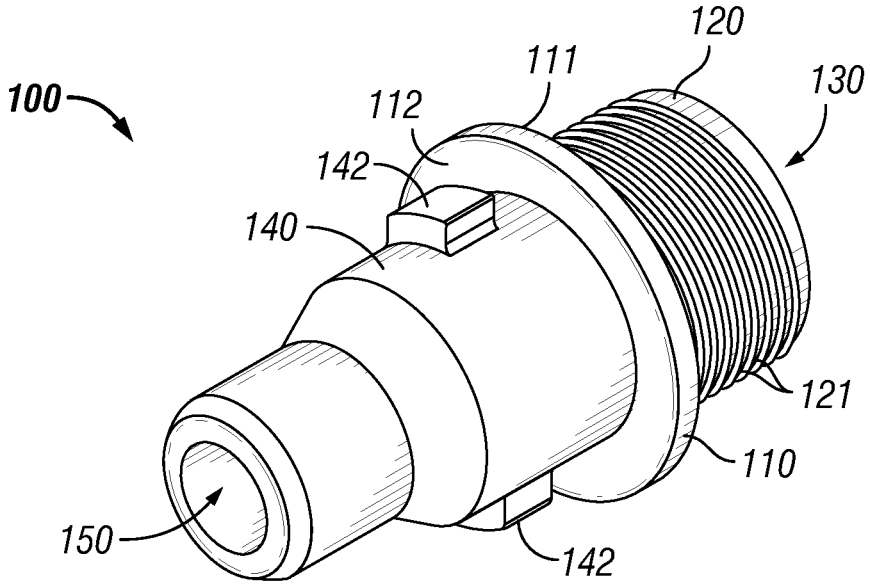
FIG. 5 is a is a perspective view of an embodiment of an end cap that includes a quick connect connector.

FIG. 5 shows an embodiment of an end cap 100. The end cap 100 includes a radial circular flange 110 having a first side 111 and a second side opposite 112 of the first side 111. The end cap 100 includes an axial circular flange 120 that extends from the first side 111 of the radial circular flange 110. The axial circular flange 120 includes exterior threads 121. The end cap 100 includes a first opening 130 (best shown in FIG. 3) that is located adjacent to the first side 111 of the radial circular flange 110. The end cap 100 includes a connector 140 that extends from the second side 112 of the radial circular flange 110. The connector 140 is configured to connect to a firearm suppressor. The connector 140 may be a quick connector that enables a firearm suppressor to be connected to the end cap within five (5) seconds or less and without the use of tools. The end cap 100 includes a second opening 150 located at the end of the connector 140. The end cap 100 includes a projectile path 160 (shown in FIG. 3) that connects the first opening 130 with the second opening 150.

The connector 140 of the end cap 100 enables a suppressor to be quickly connected to a short or compact suppressor already connected to a firearm as discussed herein. The connector 140 includes one or more external lugs 142 that mate with reciprocal openings in the end of a suppressor and which may enable the rapid attachment of a second firearm suppressor to the end cap 100 as would be appreciated by one of ordinary skill in the art having the benefit of this disclosure.

Figure 6:
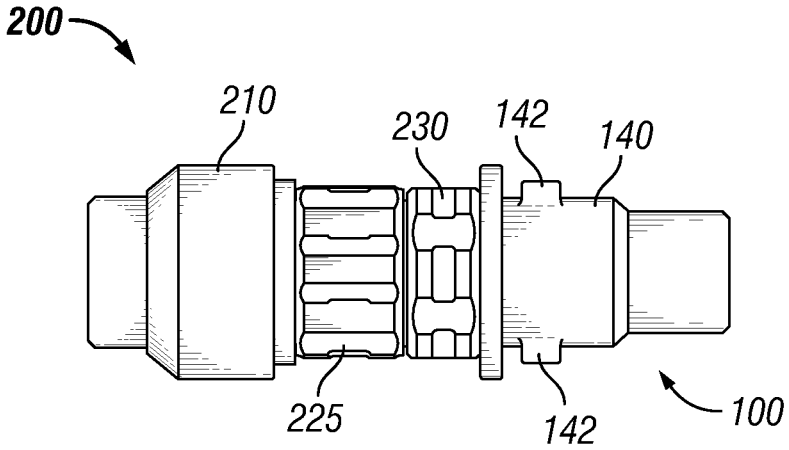
FIG. 6 is a side view of an embodiment of a suppressor that includes an adapter and end cap that includes a quick connect connector.

FIG. 6 shows an embodiment of a short or compact suppressor 200 that includes an end cap 100 having a connector 140. The suppressor 200 includes a base 210 that is configured to connect the suppressor 200 to a firearm. The suppressor 200 includes an adapter 225 that is positioned between the base 210 and a baffle 230. The end cap 100 is connected to the baffle 230. The short or compact suppressor 200 is preferably short in length with respect to traditional firearm suppressors. Thus, the suppressor 200 may only include a single baffle 230 positioned between the base 210 and the end cap 100. Alternatively, the suppressor 200 may include a small number of baffles 230, such as 2 or 3, between the base 210 and the end cap 100 to keep the compact suppressor 200 relatively short in overall length.

The compact suppressor 200 may be attached to the end of a firearm to suppress the discharge of the firearm to some extent. However, the short or compact suppressor 200 does not add much length or weight to the end of the firearm due to the compact nature of the suppressor 200. The compact suppressor 200 may be used to adjust the gas system as a firearm as the chamber between the baffle and the base 210 will cause a pressure increase upon discharge of the firearm. As discussed above, the pressure increase could potentially lead to an increase in the bolt speed of a firearm. The gas system may be adjusted with the compact suppressor 200 connected to the firearm to decrease the speed of the bolt to be at or close to the normal speed when discharged without a suppressor. A second suppressor may be rapidly connected to the compact suppressor 200 via the connector 140 as discussed herein. The second suppressor may be requisite due to an increased need to further suppress the discharge of a firearm. The connector 140 may be configured to enable a second suppressor to be connected to the firearm via the connector within five (5) seconds or less and without the use of tools. While the addition of a second suppressor may increase the pressure buildup, the increase in the pressure buildup is likely much lower in magnitude than the increase in pressure caused by the prior addition of the compact suppressor 200. Thus, a user may be able to use a firearm with a second suppressor connected to the compact suppressor 200, which was already connected to the gun, without a detrimental increase the in the bolt speed of the firearm.

Figure 7:
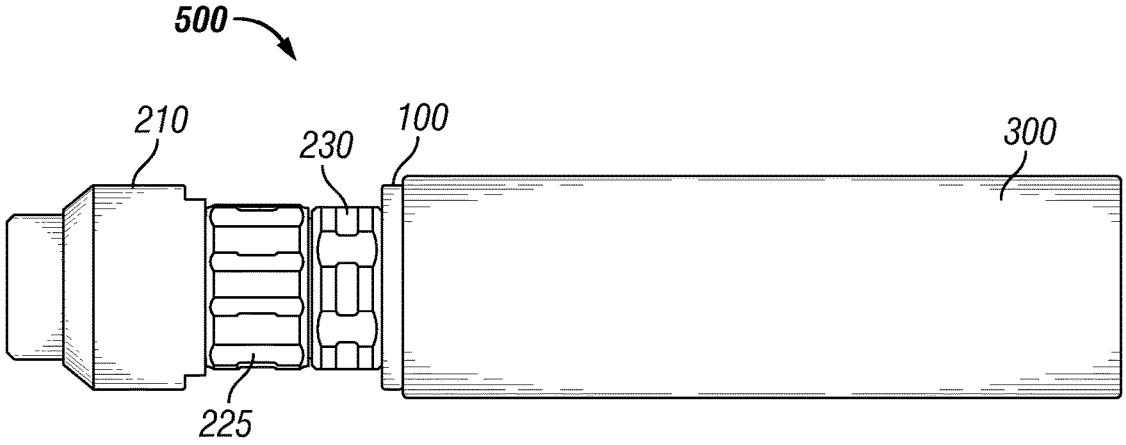
FIG. 7 is a side view of a schematic of a firearm suppressor system with a suppressor that includes an end cap having a quick connect connector with a second suppressor connected via the quick connect connector on the end cap.

FIG. 7 shows an embodiment of a firearm suppressor system 500. The firearm suppressor system 500 includes a second firearm suppressor 300 connected to the compact suppressor 200 via the connector 140 of the end cap 100 of the compact suppressor 200. The firearm suppressor system 500 includes a base 210 configured to be connected to a barrel of a firearm. The base 210 includes a first projectile pathway 211 (shown in FIG. 3) through the base 210. The firearm suppressor system 500 includes an adapter 225 positioned between the base 210 and a baffle 230 having a central aperture 231 (shown in FIG. 3). The adapter 225 includes a projectile path through the adapter 225 as would be appreciated by one of ordinary skill in the art having the benefit of this disclosure. The firearm suppressor system 500 includes an end cap 100 having a first central opening 130 (shown in FIG. 3) and a second central opening 150 (shown in FIG. 3). The end cap 100 includes a connector 140 (shown in FIGS. 1-3, 5, 8, 9) that extends from the end cap 100 away from the baffle 230. The end cap 100 includes a second projectile pathway 160 (shown in FIG. 3) that connects the first central opening 130 and the second central opening 150. The adapter 225 includes a third projectile path that is aligned with the first projectile path 211 of the base, the second projectile path 160 of the end cap 100, and the central aperture 231 of the baffle 230 as would be appreciated by one of ordinary skill in the art having the benefit of this disclosure.

The firearm suppressor system 500 includes a second firearm suppressor 300 connected to the econnector 140 of the end cap 100. The second firearm suppressor 300 includes one or more baffles to suppress the discharge of the firearm as would be appreciated by one of ordinary skill in the art having the benefit of this disclosure. A projectile path of the second suppressor 300 is aligned with the first projectile path 211 of the base, the second projectile path 160 of the end cap 100, the third projective path of the adapter 225, and the central aperture 231 of the baffle 230 as would be appreciated by one of ordinary skill in the art having the benefit of this disclosure.

Figure 8:
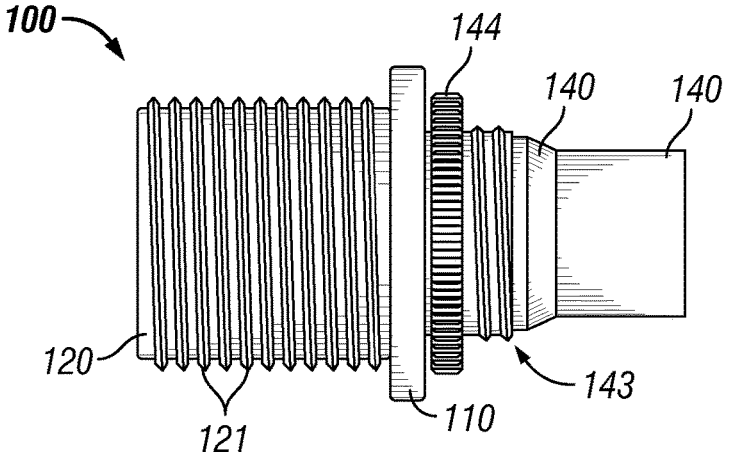
FIG. 8 is a perspective view of an embodiment of an end cap that includes a quick connect connector.

FIG. 8 shows an embodiment of an end cap 100. The end cap 100 includes a radial circular flange 110 having a first side 111 and a second side opposite 112 of the first side 111. The end cap 100 includes an axial circular flange 120 that extends from the first side 111 of the radial circular flange 110. The axial circular flange 120 includes exterior threads 121. The end cap 100 includes a first opening 130 (shown in FIG. 3) that is located adjacent to the first side 111 of the radial circular flange 110. The end cap 100 includes a connector 140 that extends from the second side 112 of the radial circular flange 110. The connector 140 is configured to connect to a firearm suppressor. The connector 140 may be a quick connector that enables a firearm suppressor to be connected to the end cap within five (5) seconds or less. The end cap 100 includes a second opening 150 (shown in FIG. 3) located at the end of the connector 140. The end cap 100 includes a projectile path 160 (shown in FIG. 3) that connects the first opening 130 with the second opening 150.

The connector 140 of the end cap 100 enables a suppressor to be quickly connected to a short or compact suppressor already connected to a firearm as discussed herein. The connector 140 includes course external threads 143 and a ring of locking teeth 144, which may enable the rapid attachment of a second firearm suppressor to the end cap 100 as would be appreciated by one of ordinary skill in the art having the benefit of this disclosure.

Figure 9:
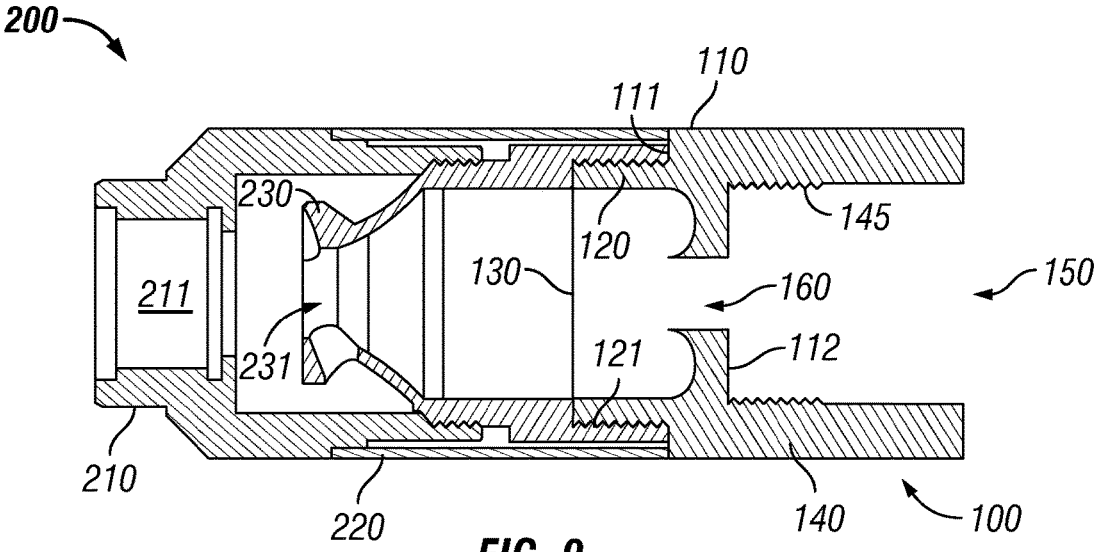
FIG. 9 is a cross-section view of an embodiment of a suppressor that includes an end cap having a quick connect connector.

FIG. 9 shows a cross-section view of a compact suppressor 200. The short or compact suppressor 200 includes an end cap 100 having a connector 140. The suppressor 200 includes a base 210 that is configured to connect the suppressor 200 to a firearm. The base 210 includes a first projectile path 211 that travels along the centerline of the base 210. The suppressor 200 includes a housing 220 that is positioned between the base 210 and the end cap 100.

The suppressor 200 includes at least one baffle 230 within the housing 220. The baffle 230 includes a central aperture 231. The short or compact suppressor 200 is preferably short in length with respect to traditional firearm suppressors. Thus, the suppressor 200 may only include a single baffle 230 positioned between the base 210 and the end cap 100. Alternatively, the suppressor 200 may include two baffles 230 between the base 210 and the end cap 100.

The end cap 100 includes a radial circular flange 110 having a first side 111 and a second side opposite 112 of the first side 111. The end cap 100 includes an axial circular flange 120 that extends from the first side 111 of the radial circular flange 110. The axial circular flange includes exterior threads 121. The end cap 100 includes a first opening 130 that is located adjacent to the first side 111 of the radial circular flange 110. The end cap 100 includes a connector 140 that extends from the second side 112 of the radial circular flange 110. The connector 140 extends away from the baffle 230 of the compact firearm suppressor 200.

The connector 140 is configured to connect to a firearm suppressor. The connector 140 includes internal threads 145 that may be used to connect a firearm suppressor to the compact firearm suppressor 200. The connector 140 may be a quick connector that enables a firearm suppressor to be connected to the end cap within five (5) seconds or less and without the use of tools. The end cap 100 includes a second opening 150 located at the end of the connector 140. The end cap 100 includes a second projectile path 160 that connects the first opening 130 with the second opening 150. The first projectile path 211 of the base 210 is aligned with the central aperture 231 of the baffle 230 as well as the second projectile path 160 of the end cap 100.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof

What is claimed is:

1. A firearm suppressor comprising:

a base, the base configured to be connected to a barrel of a firearm, the base includes a first projectile pathway through the base;

a baffle, the baffle includes a central aperture;

an end cap having a first outer diameter, a first end, a second end, a first central opening, and a second central opening, the baffle being positioned between the end cap and the base and the end cap includes a connector that extends externally from the second end of the end cap away from the baffle, the end cap having a second projectile pathway that connects the first central opening and the second central opening, wherein the end cap is baffleless and wherein the first end of the end cap is positioned toward the baffle with respect to the second end of the end cap and wherein the connector has a second outer diameter that is smaller than the first outer diameter and forms an external shoulder with the second end of the end cap; and wherein the connecter is configured to connect to a second firearm suppressor.

2. The firearm suppressor of claim 1, wherein the baffle is connected to the base and wherein the baffle is connected to the end cap.

3. The firearm suppressor of claim 1, further comprising a housing, wherein a portion of the base is positioned within the housing, wherein the baffle is positioned within the housing, and wherein a portion of the end cap is positioned within the housing.

4. The firearm suppressor of claim 3, wherein the base is connected to the housing and wherein the end cap is connected to the housing.

5. The firearm suppressor of claim 3, wherein the baffle is connected to the housing and wherein the baffle is connected to the end cap.

6. The firearm suppressor of claim 1, further comprising a baffleless adapter having a third projectile path, wherein the adapter is positioned between the base and the baffle.

7. The firearm suppressor of claim 1, wherein the connector is a quick connect connector.

8. The firearm suppressor of claim 1, wherein the connector includes external threads.

9. The firearm suppressor of claim 1, wherein the connector includes one or more external lugs.

10. The firearm suppressor of claim 1, wherein the connector includes external threads and external locking teeth.

11. The firearm suppressor of claim 1, wherein the connector includes internal threads.

12. An end cap comprising:

a radial circular flange having a first side and a second side opposite of the first side, the radial circular flange having a first outer diameter;

an axial circular flange that extends from the first side of the radial circular flange, the axial circular flange includes threads, the axial circular flange having a second outer diameter, wherein the second outer diameter is smaller than the first outer diameter;

a first opening located adjacent to the first side of the radial circular flange;

a connector that extends from the second side of the radial circular flange in a direction opposite the first side of the radial circular flange, wherein the connector is configured to connect to a firearm suppressor, the connector having a third outer diameter, wherein the third outer diameter is smaller than the first outer diameter and wherein the third outer diameter is smaller than the second outer diameter;

a second opening located on an end of the connector; and a projectile path that connects the first opening to the second opening, wherein the projectile path is baffleless.

13. The end cap of claim 12, wherein the connector includes external threads.

14. The end cap of claim 12, wherein the connector includes one or more external lugs.

15. The end cap of claim 12, wherein the connector includes external threads and external locking teeth.

16. The end cap of claim 12, wherein the connector includes internal threads.

17. A firearm suppressor system comprising:

a base, the base configured to be connected to a barrel of a firearm, the base includes a first projectile pathway through the base;

a first baffle, the first baffle includes a central aperture;

an end cap having a first outer diameter, a first side, a second side, a first central opening, and a second central opening, the baffle being positioned between the end cap and the base and the end cap includes a connector that extends externally from the second side of the end cap away from the baffle, the end cap having a second projectile pathway that connects the first central opening and the second central opening, wherein a baffle is not positioned along the second projectile path and wherein the connector has a second outer diameter that is smaller than the first outer diameter and forms an external shoulder with the second side of the end cap; and a firearm suppressor that includes one or more baffles connected to the connector.

18. The firearm suppressor system of claim 17, further comprising a baffleless adapter having a third projectile path, wherein the adapter is positioned between the base and the first baffle.

19. The firearm suppressor system of claim 17, further comprising a housing, wherein a portion of the base is positioned within the housing, wherein the first baffle is positioned within the housing, and wherein a portion of the end cap is positioned within the housing.

20. The firearm suppressor system of claim 17, wherein the connector includes external threads, internal threads, external lugs, or external threads with external locking teeth.

* * * * *